US005887973A

United States Patent [19]

Åhman et al.

[11] Patent Number: 5,887,973

[45] Date of Patent: Mar. 30, 1999

[54] DEVICE FOR MIXING PARTICULATE MATERIAL AND LIQUID

[75] Inventors: Stefan Åhman; Nils Bringfors, both of Växjö; Lars-Erik Johansson, Älmeboda, all of Sweden

[73] Assignee: ABB Fläkt AB, Stockholm, Sweden

[21] Appl. No.: 849,113

[22] PCT Filed: Nov. 24, 1995

[86] PCT No.: PCT/SE95/01401

§ 371 Date: Aug. 8, 1997

§ 102(e) Date: Aug. 8, 1997

[87] PCT Pub. No.: WO96/16727

PCT Pub. Date: Jun. 6, 1996

[30] Foreign Application Priority Data

Nov. 28, 1994 [SE] Sweden ..... 9404104

[51] Int. Cl.[6] ..... B01F 13/02

[52] U.S. Cl. ..... 366/103; 366/315

[58] Field of Search ..... 366/101, 102, 366/103, 104, 106, 107, 297, 300, 301, 302, 315; 422/139, 140, 143, 145; 118/DIG. 5, 62, 64, 65, 75, 718, 722

[56] References Cited

U.S. PATENT DOCUMENTS

| | | | |
|---|---|---|---|
| Re. 29,387 | 9/1977 | Lund | 366/300 |
| 1,247,153 | 11/1917 | Roberts | 366/104 |
| 1,420,008 | 6/1922 | Wikel et al. | 366/103 |
| 1,592,231 | 7/1926 | Stroder | 366/300 |
| 2,320,469 | 6/1943 | Rasmussen | 366/104 |
| 2,946,574 | 7/1960 | Munderich | 366/101 |
| 3,202,281 | 8/1965 | Weston | 366/101 |
| 3,343,814 | 9/1967 | Mund | 366/103 |
| 4,049,240 | 9/1977 | Walters, Jr. . | |
| 4,064,829 | 12/1977 | Hervert | 366/107 |
| 4,306,815 | 12/1981 | Majer et al. | 366/102 |

FOREIGN PATENT DOCUMENTS

| | | | |
|---|---|---|---|
| 1412119 | 12/1965 | France | 366/315 |
| 710306 | 6/1954 | United Kingdom | 366/102 |

*Primary Examiner*—Tony G. Soohoo

*Attorney, Agent, or Firm*—Burns, Doane, Swecker & Mathis, L.L.P.

[57] ABSTRACT

A device for mixing particulate material and liquid comprises a container (1), an inlet (9) for the introduction of particulate material (P1) into the container (1), a spraying means (15, 16) for spraying liquid over the particulate material in the container, an agitator (17, 17', 22, 22') arranged in the container (1), and an outlet (10) for discharging material mixed with liquid from the container (1). A fluidization means (6, 12, 13, 14) is adapted to fluidize the particulate material in the container (1) during the mixing operation.

17 Claims, 1 Drawing Sheet

DEVICE FOR MIXING PARTICULATE MATERIAL AND LIQUID

BACKGROUND AND SUMMARY

This invention concerns a device for mixing particulate material and liquid, for instance for mixing water and absorbent material which is reactive with gaseous pollutants in flue gases and which, during cleaning of the flue gases, is to be introduced into these gases in moistened state in order to convert the gaseous pollutants to separable dust, said device comprising a container, an inlet for the introduction of particulate material into the container, a spraying means for spraying liquid over the particulate material in the container, an agitator arranged in the container, and an outlet for discharging material mixed with liquid from the container.

When gaseous pollutants, such as sulphur dioxide, are to be separated from flue gases, the gases are conducted through a contact reactor in which particulate absorbent material reactive with the gaseous pollutants is, in moistened state, introduced into the flue gases in order to convert the gaseous pollutants to separable dust. The flue gases are then conducted through a dust separator, in which dust is separated from the flue gases and from which the thus-cleaned flue gases are drawn off. Part of the dust separated in the dust separator is conducted to a mixer, where it is mixed and moistened with water, whereupon it is recycled as absorbent material by being introduced into the flue gases along with an addition of fresh absorbent. As fresh absorbent, use is generally made of slaked lime (calcium hydroxide).

Devices of the type mentioned by way of introduction are used as mixers in order to perform the above mixing operation involving absorbent material and water. In these prior-art devices, the agitator consists of one or more shafts, on which are mounted agitating means in the form of helical flanges, blades, paddles or the like. However, these prior-art devices are not always capable of producing a homogeneous mixture in which the water is evenly distributed in the particulate material. As a result, moist lumps of material may form, especially when the particulate material contains a large proportion of hydrophobic particles, as is the case with fly ash.

In order that the flue gases should be efficiently cleaned, it is, of course, essential that the absorbent material is supplied to the flue gases in the form of a homogeneous mixture in which the moisture is evenly distributed.

A special object of this invention is, therefore, to provide a device which is especially adapted to be used for mixing absorbent material and water in the flue-gas-cleaning method described above and which then results in a homogeneous mixture.

A more general object of the invention is to provide a device which not only results in a homogeneous mixture of particulate material and liquid, but which also has a lower energy consumption than equivalent prior-art devices.

According to the invention, these objects are achieved by a device wherein there is provided a fluidization means adapted to fluidize the particulate material in the container during the mixing operation.

In a preferred embodiment, the container has an upper bottom and a lower bottom, which between them define a chamber and of which the upper bottom is air-permeable, and there is provided an air-supply means adapted to supply air to the chamber with a view to fluidising the particulate material in the container.

Preferably, the agitator consists of at least one rotary shaft which extends along the container and on which a plurality of discs, through the centers of which extends the shaft, are mounted in inclined state at an axial distance from one another. Conveniently, these discs have an elliptic shape and are, about their minor axes, so inclined in relation to the shaft as to have a circular axial projection. In a preferred embodiment, the discs are inclined at an angle of 45°–80°, preferably about 60°.

BRIEF DESCRIPTION OF THE DRAWINGS

The invention will now be described in more detail with reference to the accompanying drawing, in which.

DETAILED DESCRIPTION

Figure 3:
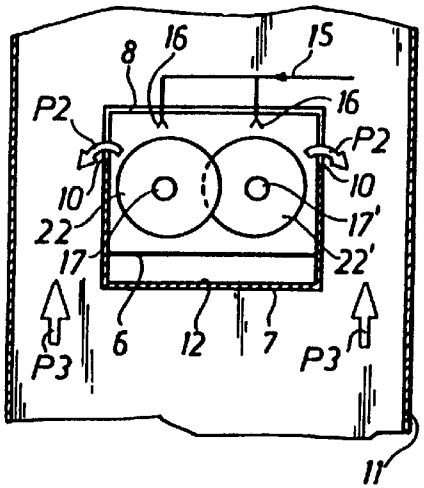
FIG. 3 is a cross-section taken along line III—III in FIG. 2.

The mixing device illustrated comprises a container 1, which essentially is in the shape of an elongate, parallelepidal box. The container 1 has vertical side walls 2 and 3, a vertical rear end wall 4, a vertical front end wall 5, a horizontal upper bottom 6, a horizontal lower bottom 7 and a horizontal top or lid 8.

Figure 1:
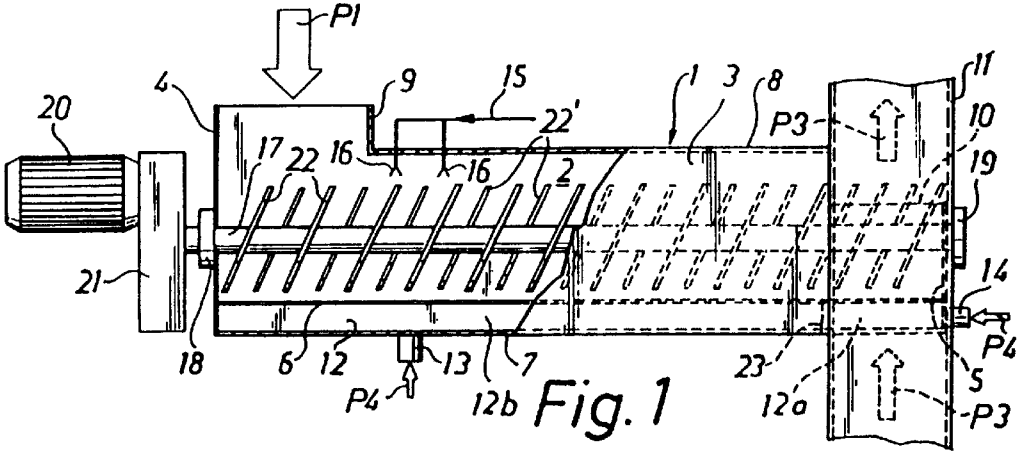
FIG. 1 is a side view which schematically illustrates a device according to the invention, but in which certain parts of the device have been broken away.
Figure 2:
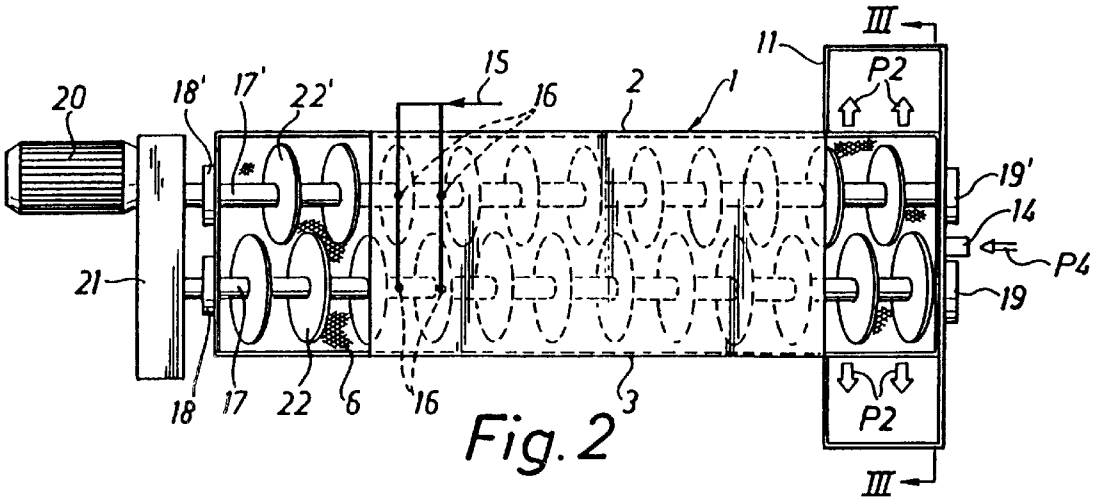
FIG. 2 is a top view of the device in FIG. 1.

At the rear end, the container 1 has an inlet 9, through which particulate material is supplied from above (the arrow P1 in FIG. 1). At the front end, the container 1 has an outlet 10, through which is discharged a homogeneous mixture of particulate material and water (the arrows P2 in FIGS. 2 and 3).

In the example shown the drawing, the front end of the container 1 is inserted in a vertical flue-gas channel 11 through which flue gases containing gaseous pollutants, such as sulphur dioxide, are conducted upwards (the arrows P3 in FIGS. 1 and 3) in order to be cleaned in known fashion. In this application, the outlet 10 is an overflow formed as a result of the side walls 2 and 3 being lower in the container part inserted in the channel 11 than in the container part located outside the channel 11. As appears from FIGS. 1 and 2, the top 8 extends from the inlet 9 to the outlet 10, i.e. up to the flue-gas channel 11.

Between them, the two bottoms 6 and 7 define a chamber 12 which, in the lateral direction, is delimited by the two side walls 2 and 3 and, in the longitudinal direction, is delimited by the two end walls 4 and 5. The ceiling of the chamber 12, i.e. the upper bottom 6, consists of an air-permeable fluidization cloth of polyester mounted in stretched state in the container 1. An air-supply means, which here consists of two air inlets 13 and 14, is arranged to supply air to the chamber 12 (the arrows P4 in FIGS. 1 and 2), so as to fluidize the particulate material in the container 1.

A water-supply line 15, which is disposed above the container 1, is connected to a plurality of nozzles 16 arranged in the upper-part of the container 1 to spray water in-finely-divided form over the particulate material in the container. The nozzles 16, of which but a few are shown in the drawing, are arranged in two parallel rows extending along the container 1.

Two juxtaposed, horizontal shafts 17, 17' extend along the entire container 1 and are rotatably mounted in the two end walls 4 and 5 with the aid of bearings 18, 18' and 19, 19', respectively. A motor 20 is arranged to rotate the shafts 17, 17' via a transmission unit 21.

Each shaft 17, 17' supports a plurality of elliptic discs 22, 22' which, about their minor axes, are mounted in inclined state on the shaft 17, 17' at an axial distance from one another. The shafts 17, 17' extend through the centers of the respective discs 22, 22'. In the example illustrated, each disc 22, 22' is so inclined in relation to the shaft 17, 17' that the angle α between the major axis of the disc and the shaft 17, 17' is about 60° (see FIG. 1). This angle a may vary between 45° and 80°. The discs 22, 22' are so inclined in relation to the respective shafts 17, 17' and have such an elliptic shape as to have a circular axial projection, as illustrated in FIG. 3. The discs 22, 22' are so positioned on the respective shafts 17, 17' that the discs of the one shaft project into the spaces between the discs of the other shaft.

Each of the discs 22, 22' arranged and designed in the manner indicated above performs, during the rotation of the shafts 17, 17', a throwing movement conducive to thorough mixing of particulate material.

The flue-gas channel 11 illustrated forms part of a system for cleaning flue gases containing gaseous pollutants, such as sulphur dioxide. The flue gases (P3) are passed through the flue-gas channel 11, in which particulate absorbent material reactive with the gaseous pollutants is, in moistened state, introduced into the flue gases in order to convert the gaseous pollutants to separable dust. The flue gases are then passed through a dust separator (not shown), in which dust is separated from the flue gases and from which the thus-cleaned flue gases are discharged into the surrounding atmosphere. Part of the dust separated in the dust separator is, along with an addition of fresh absorbent, e.g. in the form of particles of burnt lime, supplied as particulate material (P1) to the inlet 9 of the container 1, so as to be, in the container, mixed with water sprayed over the particulate material in the container through the nozzles 16. The particulate material in the container 1 is maintained in fluidized state by means of air (P4) which, via the air inlets 13 and 14, the chamber 12 and the fluidization cloth 6, is introduced into the container. As a result of this fluidization as well as the rotation of the shafts 17, 17', one obtains a homogeneously moistened, homogeneous mixture of the particulate material, this mixture being, via the overflow 10, supplied to the flue-gas channel 11 as absorbent material (P2).

By a partition 23 in the front part of the container 1, the chamber 12 is divided into a front part chamber 12*a,* which is situated in the flue-gas channel 11, and a rear part chamber 12*b.* As appears from FIG. 1, the air inlet 13 opens into the rear part chamber 12*b,* while the air inlet 14 opens into the front part chamber 12*a.* With this division of the chamber 12, it is possible to achieve different fluidization conditions in the two part chambers 12*a* and 12*b,* especially with a view to so adapting the air supply to the front part chamber 12*a* that one there obtains a suitable fluidization state for the material discharge.

In a test aiming to illuminate the effect of the fluidization on the power consumption, the container 1 was filled with particulate material. In this test, the container 1 had a volume of 0.3 $m^3$. The shafts 17, 17' were rotated at a speed of 200 rpm. The flow rate of particulate material passing through the container was 8 $m^3$/h, and the flow rate of the water was 240 l/h. In the fluidization of the particulate material, the power consumption, including the power consumption of the supply of fluidization air (0.08 $m^3$/s), was found to be 2.2 kW. With no fluidization but otherwise under the same conditions, the power consumption was 3 kW.

In the illustrated mixing device described above, the front end of the container 1 is inserted in a channel 11. However, the mixing device may also be used for discharging a homogeneously moistened, homogeneous mixture of particulate material into two separate channels, in which case the front end of the container 1 extends into these two channels in such a manner that the mixture is discharged into the one channel via the overflow 10 in the side wall 2 and discharged into the other channel via the overflow 10 in the side wall 3. The relationship between the flows of material to the two channels may be set by choosing suitable levels for the overflow 10 at the respective sides, i.e. by a suitable choice of height for the respective side walls 2, 3 in the container part inserted in the channels.

We claim:

1. A device for mixing particulate material contained in a gas and liquid, comprising:

a container;

an inlet through which gas containing particulate material is introduced into the container;

a sprayer for spraying liquid over the particulate material in the container;

an agitator arranged in the container;

an outlet for discharging material mixed with liquid from the container; and a fluidization arrangement for fluidizing the particulate material in the container.

2. A device as set forth in claim 1, wherein the container has an upper bottom and a lower bottom which at least partially define a chamber, the upper bottom being air-permeable, the fluidization arrangement including an air-supply device arranged to supply air to the chamber for fluidizing the particulate material in the container.

3. A device for mixing particulate material and liquid, comprising:

a container;

an inlet through which particulate material is introduced into the container;

a sprayer for spraying liquid over the particulate material in the container;

an agitator arranged in the container;

an outlet for discharging material mixed with liquid from the container; and a fluidization arrangement for fluidizing the particulate material in the container wherein the agitator includes at least one rotary shaft which extends along the container and on which a plurality of discs are mounted in an inclined state at an axial distance from one another, the shaft extending through centers of the discs.

4. A device as set forth in claim 3, wherein the discs have an elliptic shape and are, about minor axes of the discs, so inclined in relation to the shaft as to have a circular axial projection.

5. A device as set forth in claim 4, wherein the discs are inclined at an angle of 45°–80°.

6. A device as set forth in claim 5, wherein the discs are inclined at an angle of about 60°.

7. A device as set forth in claim 2, wherein the agitator includes at least one rotary shaft which extends along the container and on which a plurality of discs are mounted in an inclined state at an axial distance from one another, the shaft extending through centers of the discs.

8. A device as set forth in claim 7, wherein the discs have an elliptic shape and are, about minor axes of the discs, so inclined in relation to the shaft as to have a circular axial projection.

9. A device as set forth in claim 8, wherein the discs are inclined at an angle of 45°–80°.

10. A device as set forth in claim 9, wherein the discs are inclined at an angle of about 60°.

11. A device for mixing particulate material and liquid, comprising:

a container, the container having an air-permeable bottom;

an inlet through which particulate material is introduced into the container;

a sprayer for spraying liquid over the particulate material in the container;

an agitator arranged in the container;

an outlet for discharging material mixed with liquid from the container;

a chamber at least partially defined by the container bottom and separated from the container by the container bottom; and an air-supply device arranged to supply air to the chamber through the container bottom for fluidizing the particulate material in the container.

12. A device as set forth in claim 11, wherein the agitator includes at least one rotary shaft which extends along the container and on which a plurality of discs are mounted in an inclined state at an axial distance from one another, the shaft extending through centers of the discs.

13. A device as set forth in claim 12, wherein the discs have an elliptic shape and are, about minor axes of the discs, so inclined in relation to the shaf as to have a circular axial projection.

14. A device as set forth in claim 13, wherein the discs are inclined at an angle of 45°–80°.

15. A device as set forth in claim 14, wherein the discs are inclined at an angle of about 60°.

16. A device as set forth in claim 11, wherein the chamber includes a front part chamber and a rear part chamber and a partition separating the front part chamber from the rear part chamber, and the air-supply device includes a front part air supply device and a rear part air-supply device arranged to supply air to the front part chamber and the rear part chamber, respectively.

17. A device as set forth in claim 16, wherein the front part air-supply device and the rear part air-supply device are arranged to achieve different fluidization conditions in the front part chamber and the rear part chamber, respectively.

* * * * *